US008398276B2

(12) United States Patent
Pearson et al.

(10) Patent No.: US 8,398,276 B2
(45) Date of Patent: Mar. 19, 2013

(54) WALL MOUNTED AISLE, STEP AND CORRIDOR LIGHT SYSTEM

(75) Inventors: Dennis Pearson, Foothill Ranch, CA (US); Guang Jin, Santa Monica, CA (US)

(73) Assignee: Tempo Industries, LLC, Irvine, CA (US)

( * ) Notice: Subject to any disclaimer, the term of this patent is extended or adjusted under 35 U.S.C. 154(b) by 409 days.

(21) Appl. No.: 12/788,122

(22) Filed: May 26, 2010

(65) Prior Publication Data

US 2011/0222268 A1 Sep. 15, 2011

Related U.S. Application Data

(60) Provisional application No. 61/313,555, filed on Mar. 12, 2010.

(51) Int. Cl.
*F21S 8/00* (2006.01)

(52) U.S. Cl. ..... 362/432; 362/248

(58) Field of Classification Search ..... 362/248, 362/345, 364, 365, 366, 351, 432, 457
See application file for complete search history.

(56) References Cited

U.S. PATENT DOCUMENTS

| | | | | |
|---|---|---|---|---|
| 5,050,047 | A * | 9/1991 | Viner et al. | 362/552 |
| 6,213,622 | B1 | 4/2001 | Shimada | |
| 6,220,724 | B1 * | 4/2001 | Krokeide | 362/240 |
| 6,554,446 | B1 | 4/2003 | Walsh | |
| 6,595,671 | B2 | 7/2003 | Lefebvre et al. | |
| 7,160,007 | B2 | 1/2007 | Pan | |
| 2005/0265019 | A1 | 12/2005 | Sommers et al. | |
| 2008/0002399 | A1 | 1/2008 | Villard et al. | |
| 2010/0091489 | A1 | 4/2010 | Pearson et al. | |
| 2011/0032703 | A1 | 2/2011 | Pearson et al. | |

FOREIGN PATENT DOCUMENTS

| | | | |
|---|---|---|---|
| KR | 10-0661404 | B1 | 12/2006 |
| KR | 10-2007-0039683 | A | 4/2007 |

OTHER PUBLICATIONS

Tempo Industries, 3700 Series Sentinel, "Sentry Seat-Mounted Lighting" 2 pages (2005) Tempo Industries, Irvine, CA.
Tempo Industries, Sentinel System, "Wall Mounted LED Stair Lighting System" 2 pages (2002) Tempo Industries, Irvine, CA.
Tempo Industries, Sentinel System, "Rail & Seat Mounted LED Stair Lighting Products" 1 Page (2002) Tempo Industries, Irvine, CA.
Tempo Industries, Sentinel System, "2100GS—Single Step—Grey Stripe Left or Right End Cap" 2 pages (2002) Tempo Industries, Irvine, CA.
Tempo Industries, Guardian (Orange Sidebar), "Tread/Riser Stair Nose Lighting" 3 Pages (2005) Tempo Industries, Irvine, CA.

(Continued)

*Primary Examiner* — Anh Mai
*Assistant Examiner* — Andrew Coughlin
(74) *Attorney, Agent, or Firm* — Greenberg Traurig LLP; Franklin D. Ubell

(57) ABSTRACT

A wall light system including a single piece wall mount extrusion having a vertical rear mounting surface and a horizontally extending light shield. The interior of the vertical rear mounting surface has first and second projections extending therefrom defining a first slot, while the interior of the light shield has a downwardly extending vertical projection and a horizontal projection formed thereon, which together define a second slot. A lampholder has lower and upper tongues positioned to snap fit into the first and second slots, respectively, and mounts a circuit board which carries one or more LEDs.

49 Claims, 10 Drawing Sheets

OTHER PUBLICATIONS

Tempo Industries, Guardian (Orange Sidebar), "Step Edge Lighting" 2 Pages (2005) Tempo Industries, Irvine, CA.
Tempo Industries, Sentinel (Yellow Sidebar), "Sentinel Striped Step Nose" 2 Pages (2005) Tempo Industries, Irvine, CA.
Tempo Industries, Internal Drawing, Never Published (drawing of rail light installed at 10 Deg.) 1 Page (2002) Tempo Industries, Irvine, CA.
Tempo Industries, Sentinel with biinary technology, "Product Brochure Wall Light, Rail Light, Striped Step Nose" 8 Pages (2007) Tempo Industries, Irvine, CA.
Form PCT/ISA/210 in connection with PCT/US2011/026418 dated Oct. 28, 2011.
Form PCT/ISA/237 in connection with PCT/US2011/026418 dated Oct. 28, 2011.

* cited by examiner

WALL MOUNTED AISLE, STEP AND CORRIDOR LIGHT SYSTEM

CROSS REFERENCE TO RELATED APPLICATIONS

This application claims the benefit of and priority to U.S. Provisional Application Ser. No. 61/313,555, filed Mar. 12, 2010, entitled, "Theatre Wall Light System," the contents of which is incorporated by reference herein in its entirety.

BACKGROUND

1. Field

The subject disclosure relates to lighting systems and fixtures and more particularly to a wall light system, which in some embodiments is particularly adapted to illuminate aisles, steps and corridors of theaters and other venues.

2. Related Art

In the past, wall lighting has been provided in theaters and other venues to assist in safely guiding patrons to their seats.

SUMMARY

The following is a summary description of illustrative embodiments of the invention. It is provided as a preface to assist those skilled in the art to more rapidly assimilate the detailed design discussion which ensues and is not intended in any way to limit the scope of the claims which are appended hereto in order to particularly point out the invention.

An illustrative wall light system embodiment includes a single piece wall mount extrusion and a single piece lampholder, which mounts an LED-carrying circuit board. The single piece wall mount extrusion includes a vertical rear mounting surface whose interior surface has first and second projections extending therefrom, the first and second projections defining a slot for receiving a lower tongue of the single piece lampholder.

An integrally formed lampshield extends generally horizontally and downwardly from a top edge of the vertical rear mounting surface of the wall mount extrusion. In one embodiment, the lampshield includes a first horizontally extending planar section, a second planar section, integrally formed with the first horizontal planar section and angled downwardly therefrom, and a third planar section, integrally formed with the second section and angled downwardly therefrom. The interior of the lamp shield portion of the wall mount extrusion has a downwardly extending vertical projection and an inwardly extending horizontal projection, which are shaped and dimensioned to define an upper slot into which fits an upper tongue of the single piece lamp holder. In one embodiment, the lampholder and accompanying wireway covers snap into the extrusion and lend rigidity thereto.

In one embodiment; respective side light shields extend horizontally from the lampholder positioned on opposite sides of the circuit board, and a plurality of additional light shields are formed between the side shields along a lower edge of the lampholder to assist in shielding the LEDs from normal view.

In one embodiment, the circuit board is spaced apart from the front surface of the lampholder to define a gap between the front surface and the circuit board. A prying tool is further provided having a tip insertable into the gap for prying the circuit board out of the lampholder.

In an illustrative embodiment, first and second apertures are formed in the circuit board disposed opposite respective first and second apertures in the lampholder and first and second electrical conductor pins pass through the respective first and second apertures of the circuit board and lampholder to provide power to the LEDs. First and second electrical leads are connected to the first and second contact pins and run adjacent a back surface of the larnpholder. A pin retainer is provided, which is releasably mountable to the back surface of the lampholder, to retain the pins and leads in position.

With apparatus constructed according to the illustrative embodiments, a wall light may be entirely assembled at the factory by snapping a lampholder with a circuit board in place into a wall mount extrusion 13 and then snapping adjacent wireway covers in place in the extrusion. Therefore, in the field, only the single piece assembly needs be attached to a wall or other surface. This approach provides a simplified installation procedure estimated to save roughly 20 to 25% on labor costs over prior systems which require assembly of two or more extruded parts in the field.

DRAWINGS

Illustrative embodiments will now be described in greater detail in conjunction with the drawings of which:

DETAILED DESCRIPTION

As seen in the Figures, the wall light 11 includes a single piece wall mount extrusion 13 and a single piece lampholder 15. In one embodiment, the wall mount extrusion is fabricated of rigid PVC and the lampholder is an ABS plastic molded port. Various other materials could be used in alternate embodiments.

Figure 1:
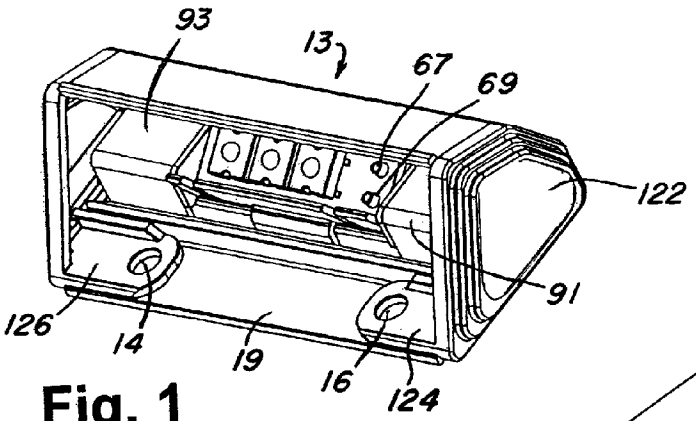
FIG. 1 is a perspective view of an illustrative embodiment of a wall mountable light.

The single piece wall mount extrusion 13 includes a vertical rear mounting surface 17, which is generally planar to flushly abut a flat adjacent vertical wall. The interior surface 19 of the rear mounting surface 17 has respective mounting holes 14, 16 therein (FIG. 1) and first and second projections 21, 23 (FIG. 3) extending therefrom. The first and second projections 21, 23 define a slot 25, which receives a lower tongue 27 of the lampholder extrusion 15. The second projection 23 has a downwardly sloping lip or ramp 24 formed at its end.

Figure 2:
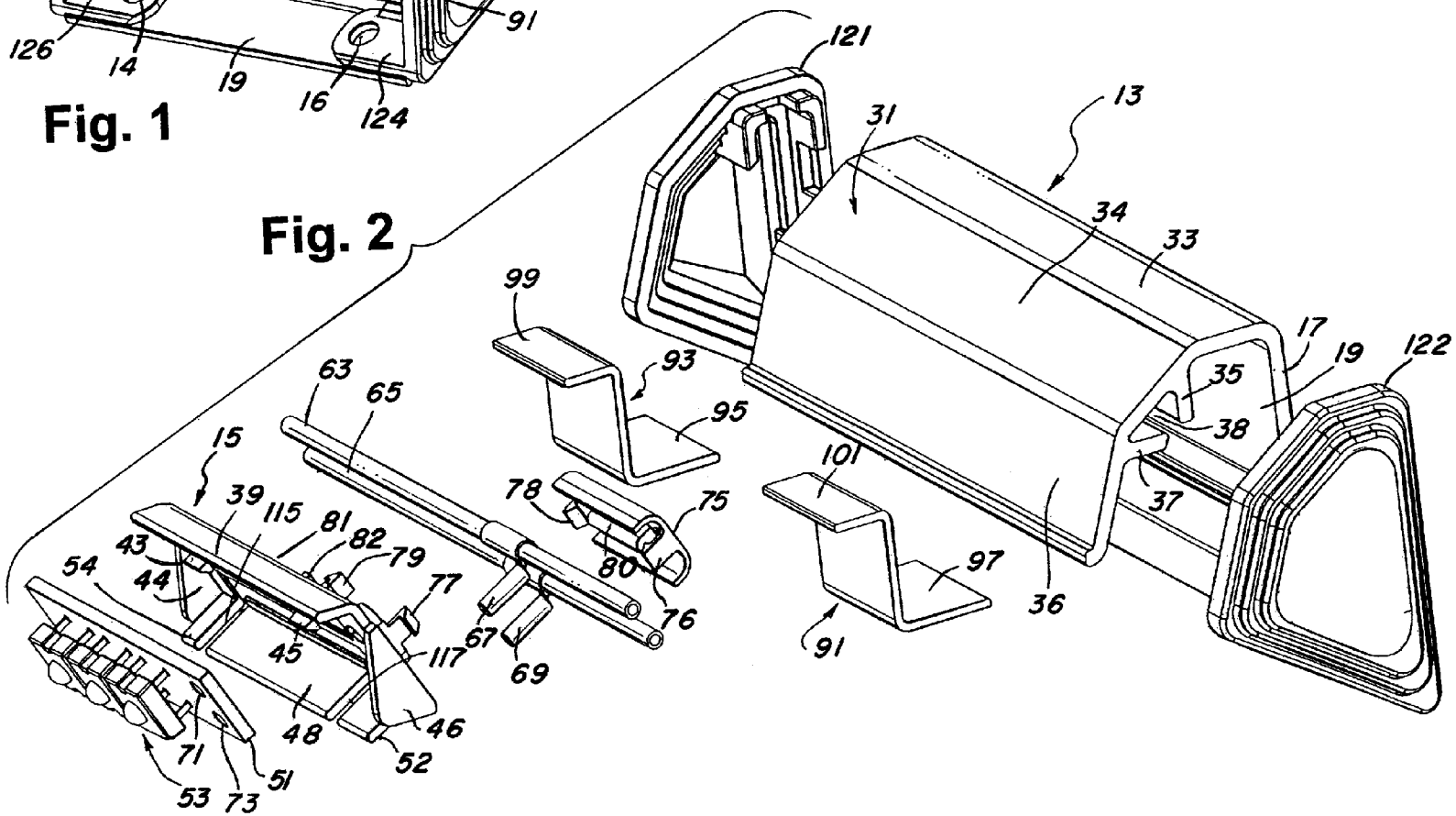
FIG. 2 is an exploded perspective view of the light of FIG. 1.
Figure 4:
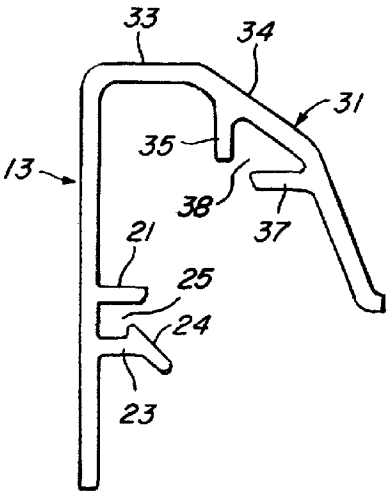
FIG. 4 is an end view of a single piece extrusion component of the light of FIG. 1.
Figure 3:
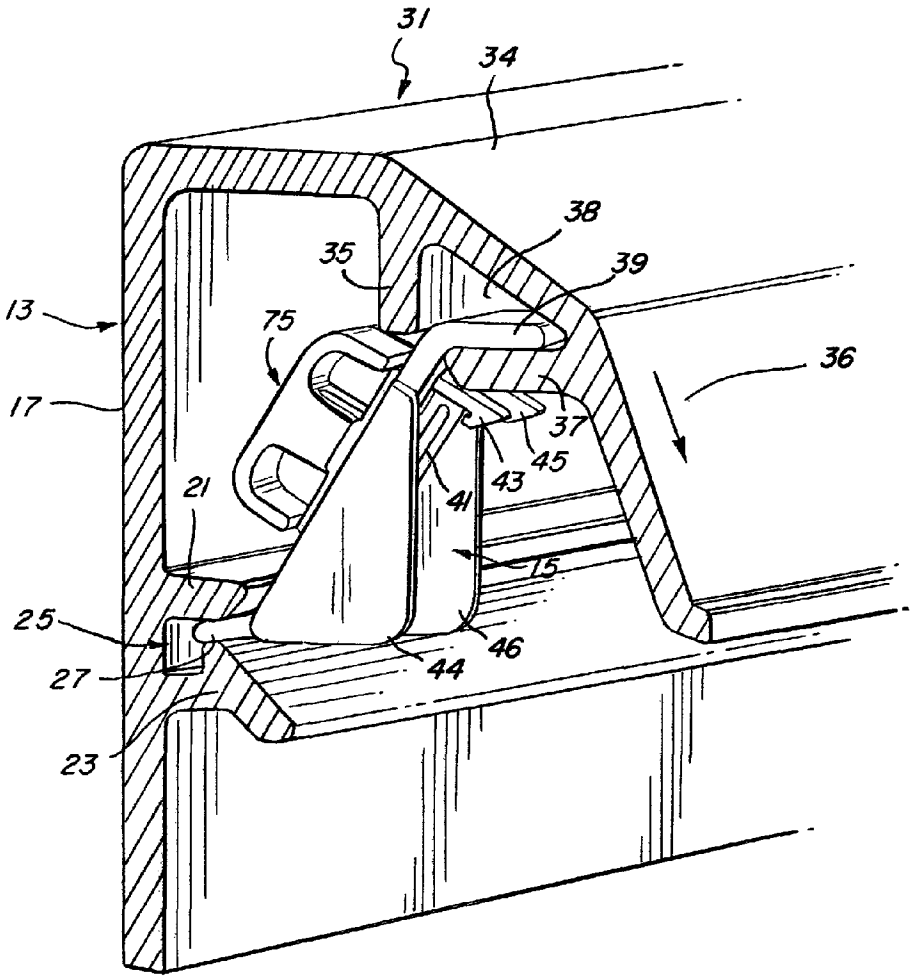
FIG. 3 is a partial sectional perspective view of the light of FIG. 1.

As further illustrated in FIGS. 2 and 3, at the top of the rear mounting surface 17 is formed a lampshield 31, which includes a first horizontally extending planar section 33, a second planar section 34, integrally formed with the first horizontal planar section 33 and angled downwardly therefrom, and a third planar section 36 integrally formed with the second section 34 and angled downwardly at a second angle. In one illustrative embodiment, the first and second angles are 55 and 20 degrees from the vertical, respectively.

As shown in FIG. 3, on the interior of the shield 31 is formed a downwardly extending vertical projection 35 and a horizontal projection 37. The vertical and horizontal projections 35, 37 are shaped and dimensioned to define an upper slot 38 into which fits an upper tongue 39 of the lamp holder 15. Between the upper and lower tongues 27, 39 of the lampholder 15 is positioned an integrally formed generally planar surface 41. A pair of integrally formed lampholder tongues 43, 45 extend from the front surface 41 and are disposed perpendicularly thereto.

The tongues 43, 45 and rectangular lower lip 48 may retain a circuit board 51 (FIG. 1), which mounts one or more LEDs 53. Respective generally triangularly shaped side light shields 44, 46 are located on opposite sides of the circuit board 51 and respective rectangular lower edge light shields 54, 48, 52 (FIG. 2, FIG. 7) are formed along a lower edge of the lampholder 15.

In one embodiment, the circuit board 51 may be 1½ inches long and mounts 3 LEDs 53. In another embodiment, the board 51 may mount a single 3 emitter, 20 ma RGB LED. Various other combination of LEDs of various power ratings may be used A dual circuit system may also be employed were every other LED connects to an alternate one of two transformers, thereby insuring light if one LED burns out.

Power is provided to the LEDs 53 via two power wires 63, 65 through respective contact pins 67, 69. These pins 67, 69 pass through suitable apertures 70, 72 in the lamp holder 15 and through respective holes 71, 73 in the circuit board 51, The pins 67, 69 are held in position by a pin retainer 75, which has respective prongs 76, 78 which may snap-fittingly mate with respective prongs 77, 79 protruding from the rear surface 81, of the lamp holder 15. The pin retainer 75 may be fabricated, for example, of injection molded plastic.

Respective identical wireway covers 91, 93 are also provided. They each include lower planar surfaces 95, 97 which are each shaped, dimensioned and positioned to fit into the lower slot 25 of the wall extrusion 13, as well as upper planar surfaces 99, 101, which are shaped, dimensioned and positioned to fit into the upper slot 38 defined by projections 35, 37 on the interior of the shield 31. Such wireway covers 91, 93 may be formed, for example, of injection molded plastic.

Figure 5:
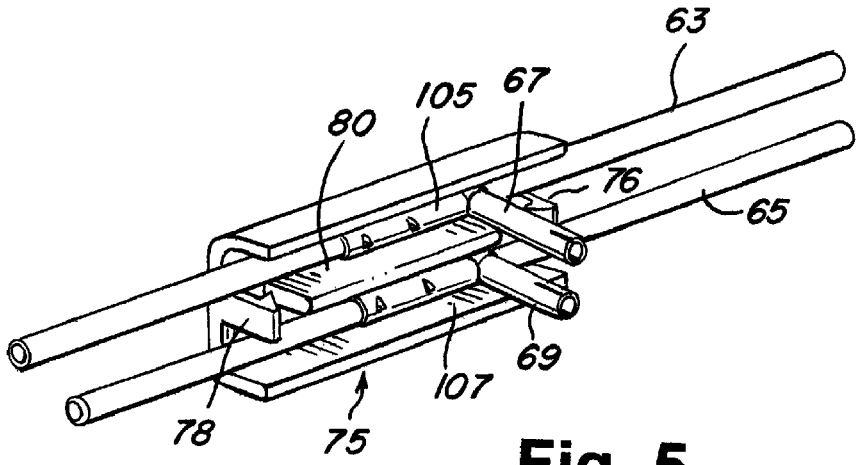
FIG. 5 is perspective view of a retainer component of the light of FIG. 1.

FIG. 5 further illustrates the manner in which the power wires 63, 65 interface with the pin retainer 75. In particular, the wires 63, 65 each enter and exit wire guides defined by the respective side surfaces of the prongs 76, 78 of the pin retainer 75. Additionally, a non-conductive, elongated projection 80 of rectangular side profile and rectangular cross-section is positioned between the respective conductive contact pins 67, 69 thereby insulating them from one another and preventing short circuits.

Figure 6:
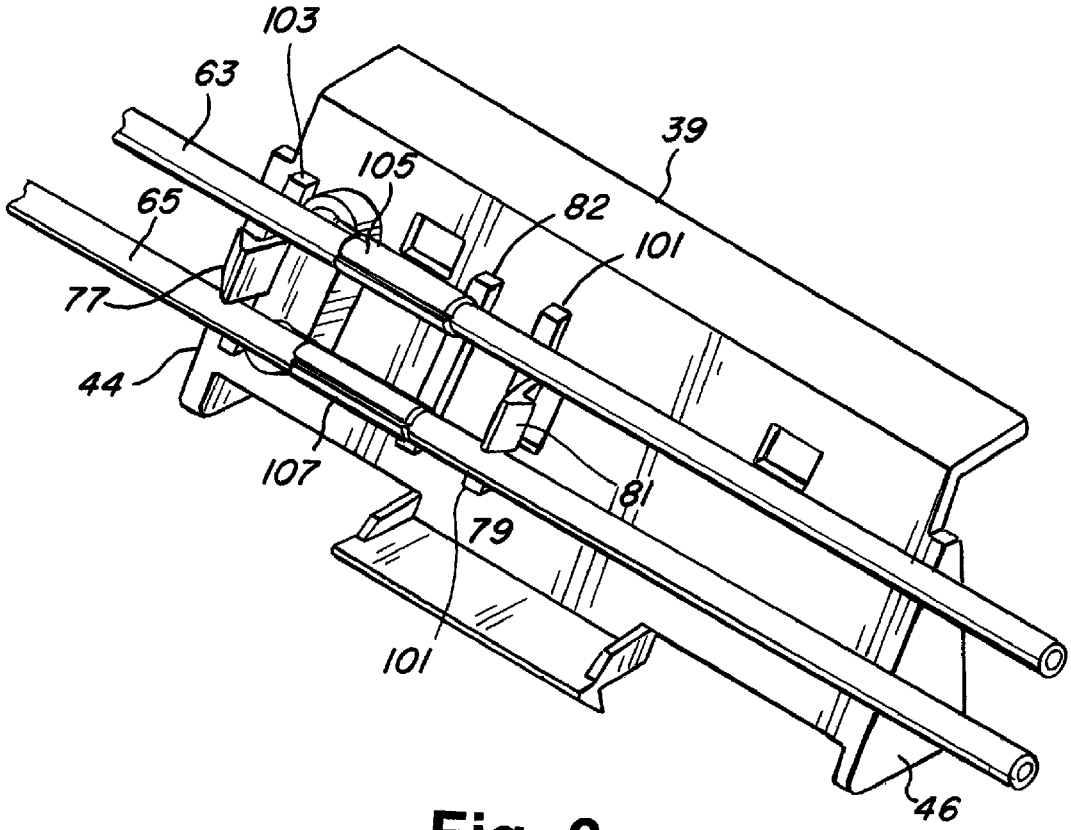
FIG. 6 is a rear perspective view of a lampholder component embodiment.

As shown in FIG. 6, each power wire 63, 65 is further supported by respective reduced height edges 101, 103 formed on either side of the tabs 77, 81. Additionally, each contact pin 67, 69 receivers underside support from a raised surface or bar 82, which in the illustrated embodiment is of rectangular cross-section. The support provided by the edges 101, 103 and the bar 82 further position the contact pin 67, 69 to extend the correct or selected length from the surface 41.

Figure 7:
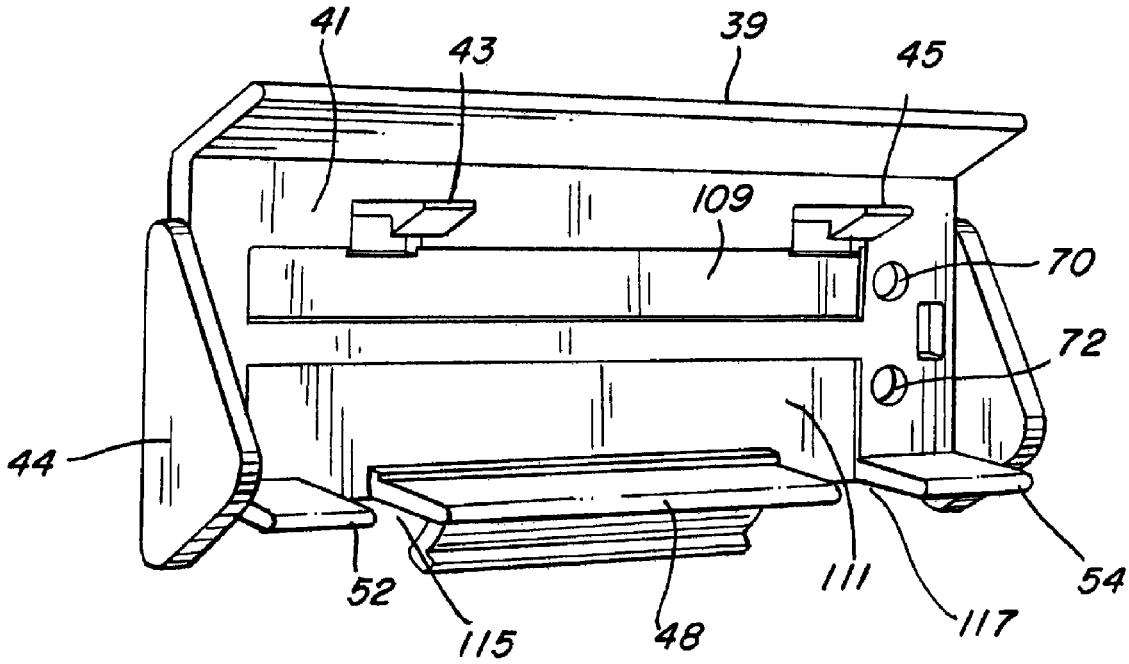
FIG. 7 is a front perspective view of a lampholder embodiment.
Figure 8:
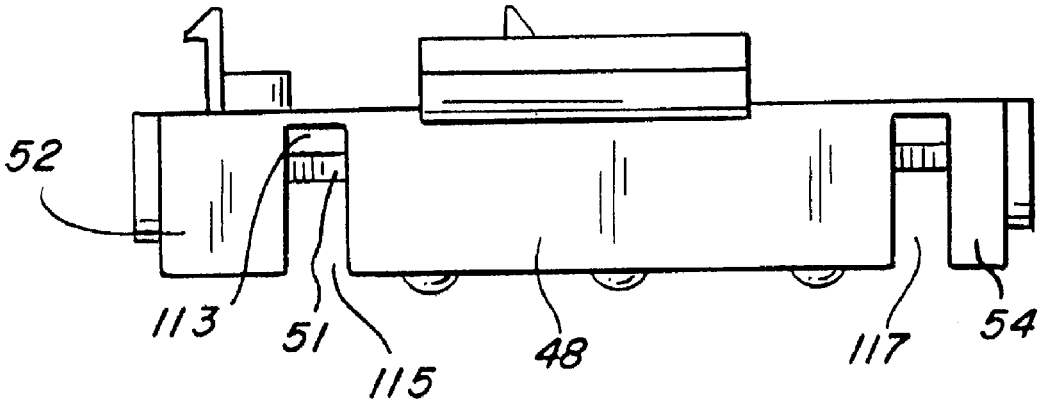
FIG. 8 is a fragmentary bottom view of the lampholder of FIG. 7.

FIG. 7 illustrates an embodiment wherein first and second depressions 109, 111 are formed in the generally flat or planar front surface 41 of the lampholder 15. These depressions 109, 111 are generally rectangular and of a constant depth. The depressions 109, 111 accommodate the soldering underneath the circuit board 51 while raising the circuit board 51 slightly above the surface 41, thereby creating a gap 113, as shown in FIG. 8. The gap 113 of FIG. 8 is particularly exposed at the spaces 115, 117 between the central lower edge light shield surface 48 and the respective adjacent lower edge light shield surfaces 52, 54. In various alternate embodiments, one or more depressions of varying shapes or one or more surfaces raised above the plane of front surface 41 could be used to space the circuit board 51 apart from the front surface 41 of the lampholder 15.

Figure 9:
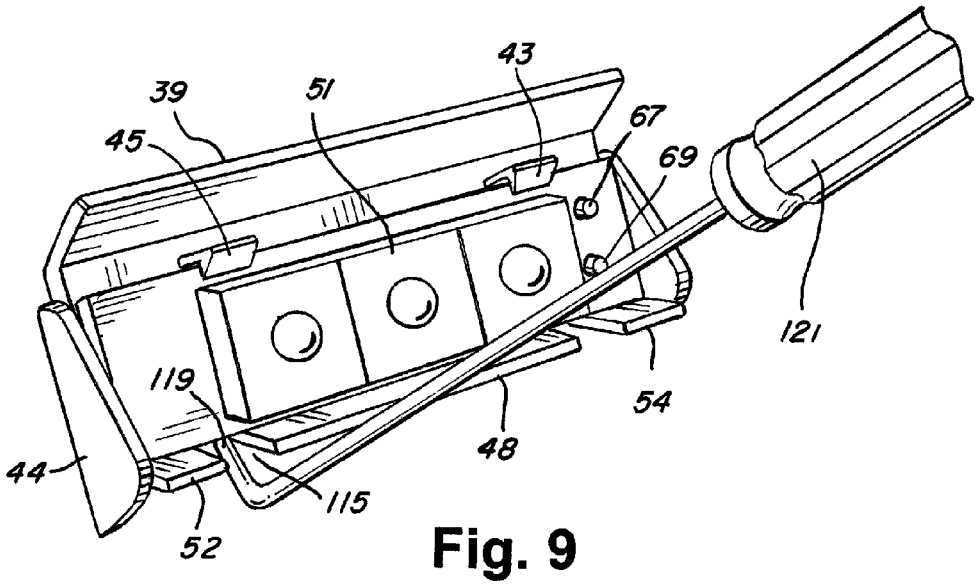
FIG. 9 is a fragmentary front perspective view illustrating application of a circuit board removal tool.
Figure 10:
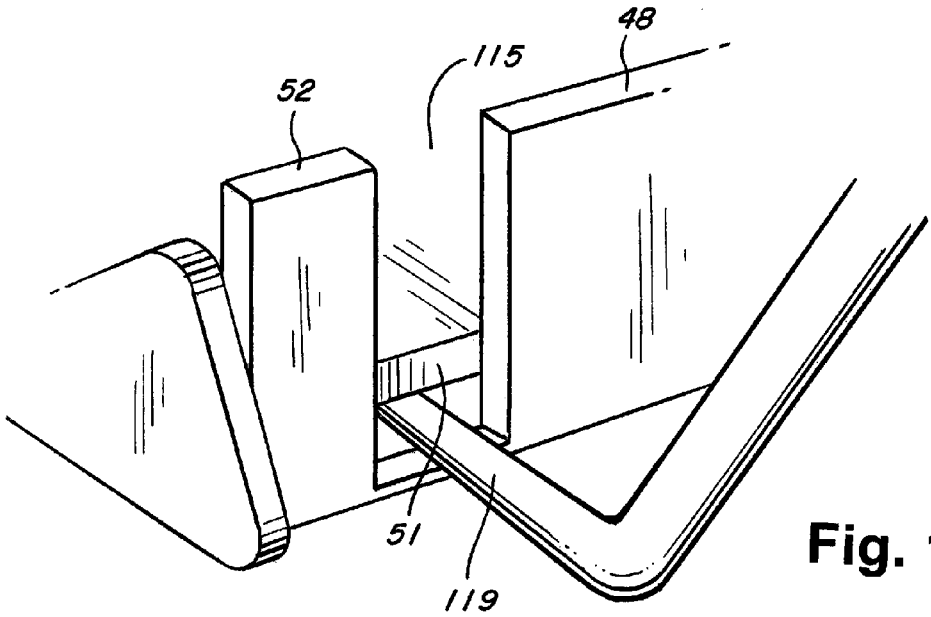
FIG. 10 is a fragmentary perspective view further illustrating use of the tool of FIG. 9.

As illustrated in FIGS. 9 and 10, the gaps 115, 117 permit insertion of the pointed tip 119 of a prying tool 121 into each of them to thereby pry the circuit board 51 up and out of the lampholder 15 in order to replace it, should the need arise. The prying tool 121 is constructed like a conventional screw driver with a hooked and pointed end 119 formed thereon to facilitate removal of the circuit board 51. A replacement circuit board may then be inserted by aligning the contact pins 67, 69 with the circuit board holes 71, 73 of the replacement board and then pressing the replacement board down until it snaps into the hooks 43, 45.

To install a wall light unit constructed according to the illustrative embodiments, the lampholder 15 with circuit board 51 and LEDs 53 in place is snapped into the wall extrusion 13. Wireway covers 93, 97 are then installed and suitable end caps 121, 122 with mounting tabs 124, 126 (FIG. 1) are attached. The extrusion 13 is then attached by suitable fastening devices inserted through holes 14, 16 and tabs 123, 124 to a wall or other surface. The electrical connectors are then plugged-in.

Figure 11:
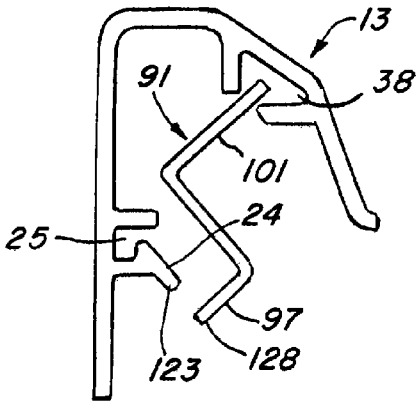
FIGS. 11-15 are end views schematically illustrating steps in the insertion of a wireway cover or lampholder into a wall mount extrusion according to an illustrative embodiment.
Figure 14:
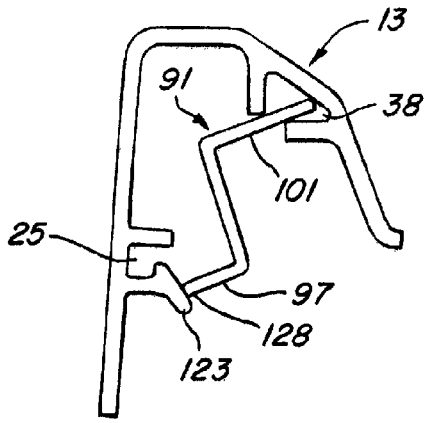
Figure 12:
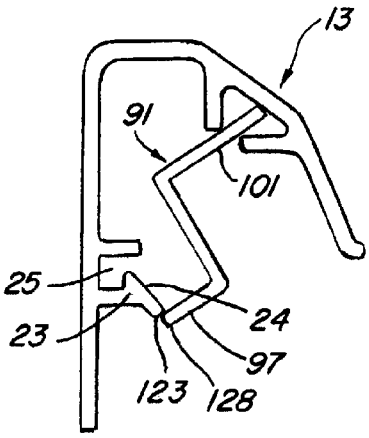
Figure 15:
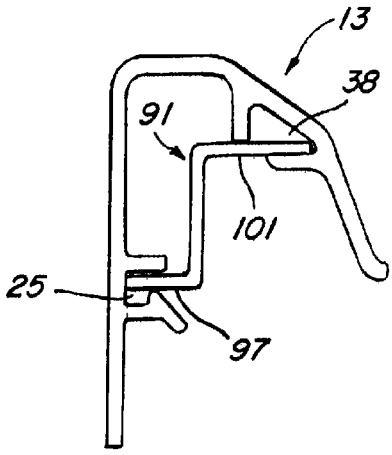
Figure 13:
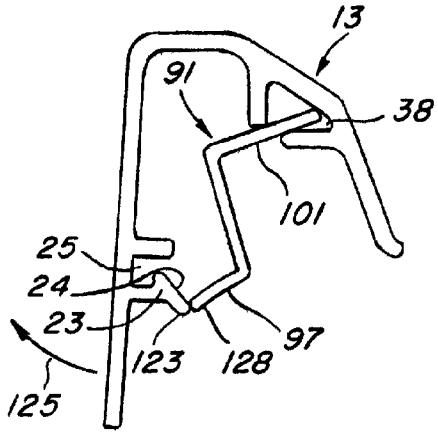

FIGS. 11-15 further illustrate the manner in which the lampholder 15 and adjacent first and second wireway covers 91, 93 snap into the wall mount extrusion 13, according to one embodiment, particularly illustrating insertion of the first wireway cover 91. As shown in FIG. 11, the upper planar surface 101 of the wireway cover 91 is first inserted into the upper interior slot 38 of the wall mount extrusion 13. The lower planar surface 97 of the cover 91 is then rotated towards, and into abutment with, the tip 123 of the flat downward sloping surface 24 of the second interior projection 23 (FIG. 12). As shown in FIGS. 13 and 14, the vertical wall of the extrusion 13 is then manually bent slightly in the direction of the arrow 125 to space it away from the tip 128 of the lower planar surface 97, while, at the same time, the tip 128 is manually pushed up the ramp 24 until the lower planer surface 97 snaps into the slot 25, as shown in FIG. 15, thereby fixing the wireway cover 91 in position in the extrusion 13. The lampholder 15 is similarly snapped into position by first inserting the planar upper tongue 27 into the upper interior slot 38, bending the extrusion in the direction of arrow 125, and thereafter snapping the lower planar tongue 39 into the lower slot 25.

In one embodiment, by proper selection of materials and dimensioning, the wireway covers 97, 99 are designed to add structural stiffness to the extrusion 13 thereby assisting in holding the combined structure to the tolerances necessary to avoid exposing the LEDs 53 to normal view. In one embodiment, the wireway covers 97, 99 may be fabricated from rigid PVC.

Figure 16:
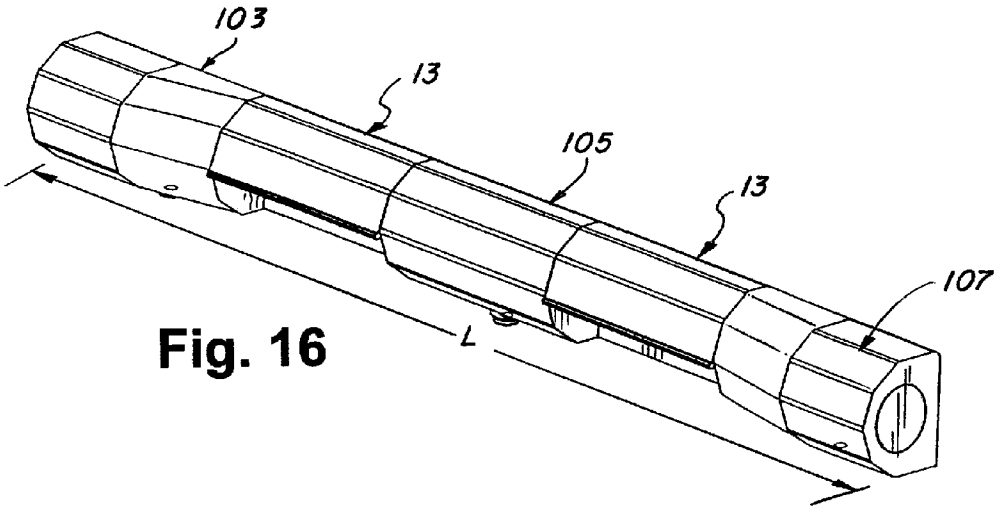
FIGS. 16 and 17 are perspective views illustrating junction box componentry.
Figure 17:
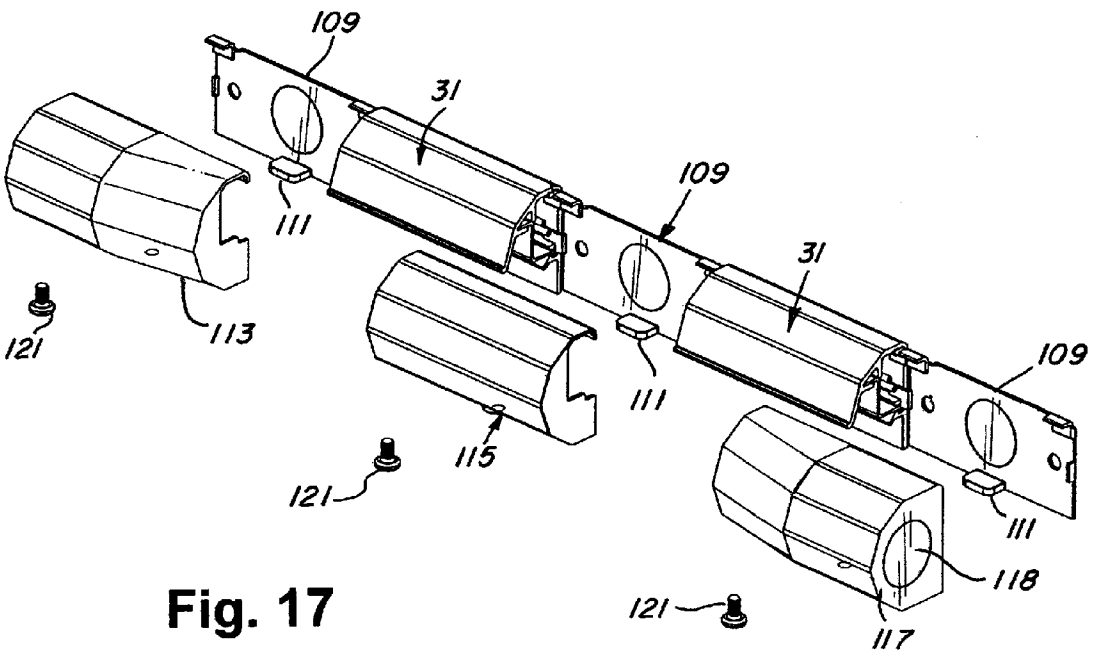

FIGS. 16 and 17 illustrate junction boxes for use with wall light fixtures 13. As shown, the junction boxes 103, 105, 107 include respective rectangular bases 109 with respective feet 111 projecting horizontally from the lower edge of each base 109. Respective left, central and right covers 113, 115, 117 attach to the base members 109 via screws or other suitable fasteners 121. The covers 113, 115, 117 are shaped to match the contours of the adjacent wall mount extrusions 13 so as to provide a smooth seamlessly appearing front surface over the entire length "L" of the fixture. Kickouts, e.g., 118, are provided to permit entry of a power feed through the end of the junction box cover 117. In one embodiment, the junction boxes may be fabricated of die casting zinc alloy such as, for example, Zamak 3.

Figure 18:
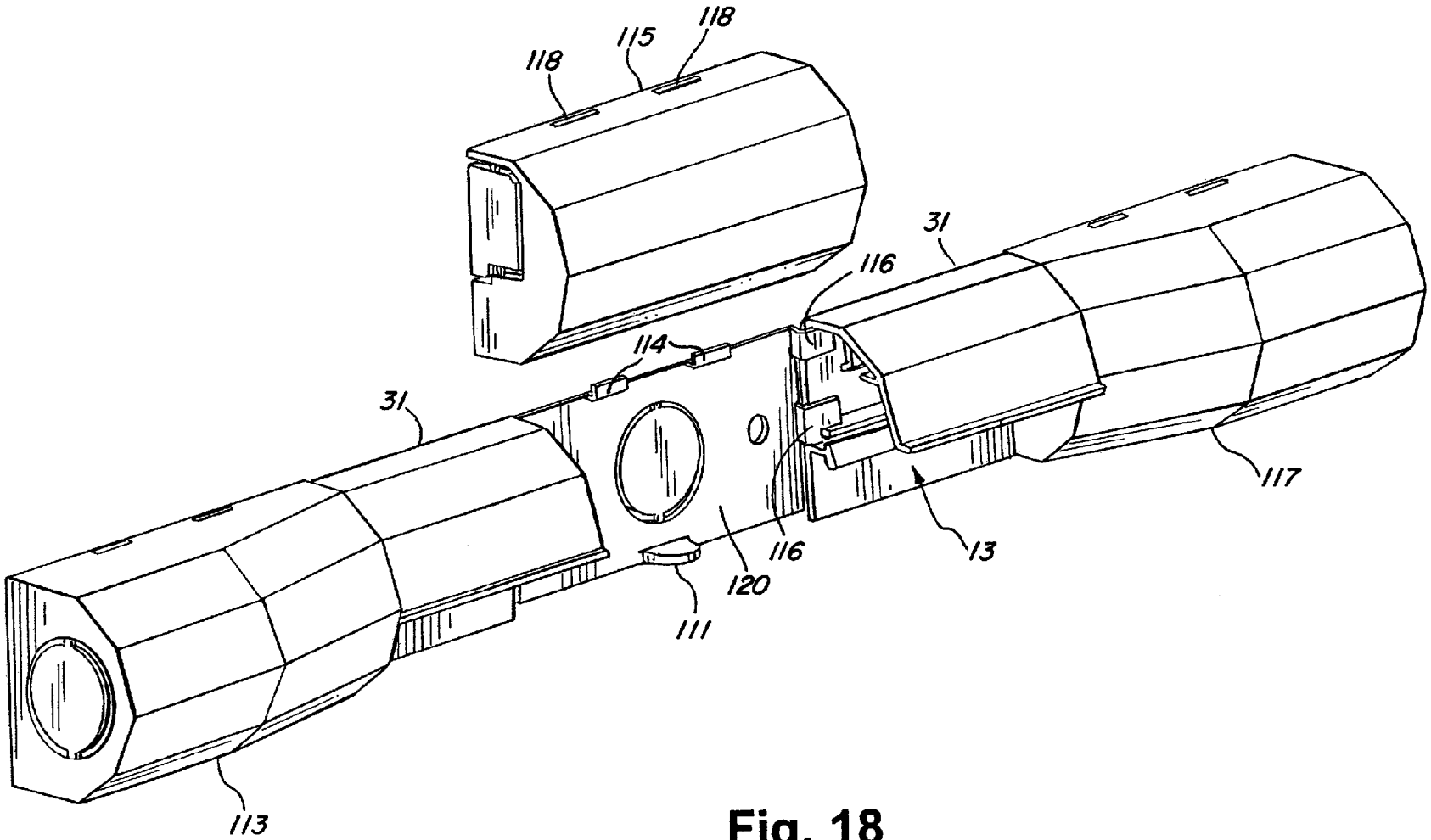
FIG. 18 is a perspective view of an alternate junction box embodiment.

FIG. 18 illustrates an alternate tab and slot fit junction box embodiment where tabs 114 located on a top edge of a base member 120 engage slots 118 formed on a top edge of a cover member 115. Tabs 116 further overlap the side edge of an adjacent wall mount extrusion 13 and align the base member 120 with the extrusion 13.

Figure 20:
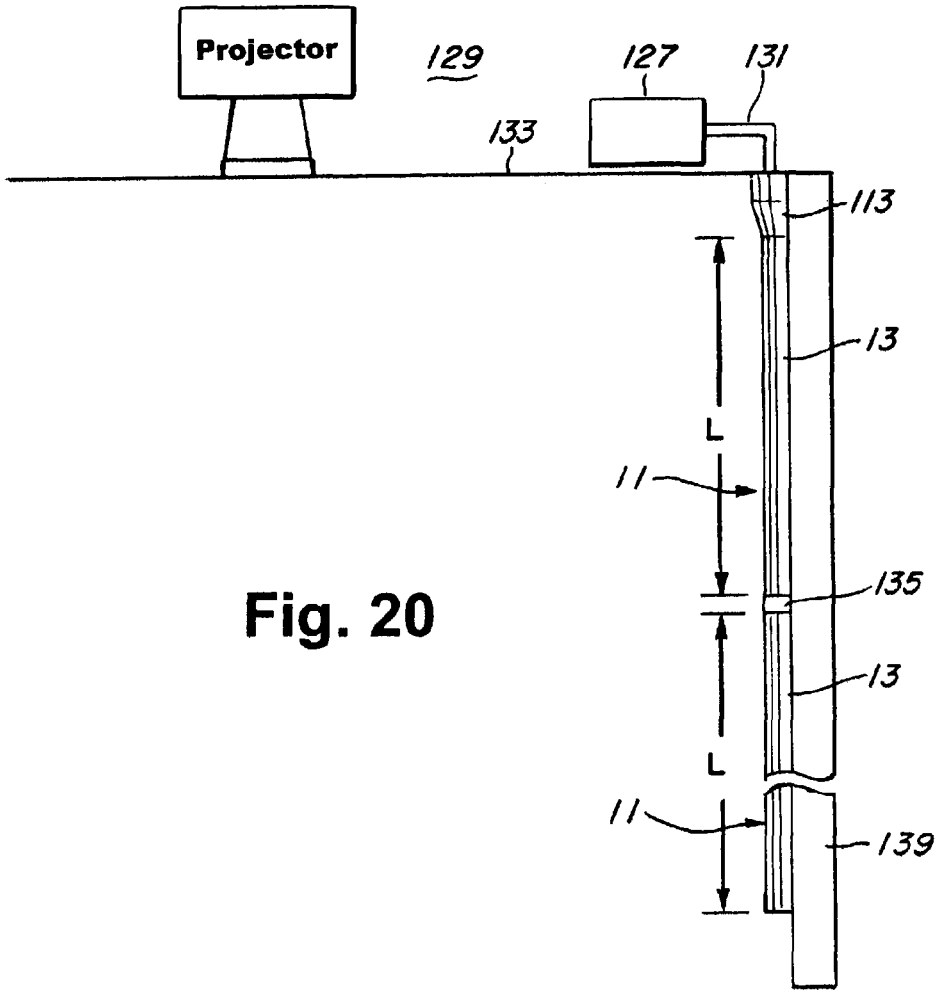
FIGS. 20 and 21 are plan views illustrating installation of wall light components according to an illustrative embodiment.
Figure 21:
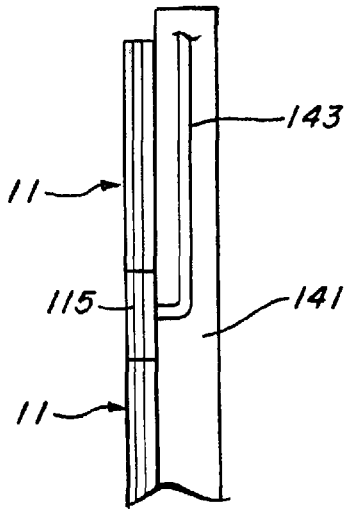

FIG. 20 illustrates use of a "left" junction box 113. In the application shown, a transformer 127 is located in a theatre projection booth 129 and its power cable 131 passes through a front wall 133 and into the junction box 113 where the cable 131 is connected to the cable of a wall light 11, which, in the illustrative application, is furnished in standard eight foot lengths. A "joiner" 135 interfaces between a first eight foot section 11 and a second eight foot section 11, which are each attached to a side wall 139. In FIG. 21, a power cable 143 exits from, for example, a location in the middle of a theatre side wall 141, in which case a central junction box 115 is employed.

With apparatus constructed according to the illustrative embodiments, wall lights 11 may be entirely assembled at the factory by snapping the lampholders 15 with circuit boards 51 in place into the wall mount extrusions 13 and then snapping adjacent wireway way covers 91, 93 in place in the extrusions 13. Therefore, in the field only the single piece assembly needs to be attached to a wall or other surface. This approach provides a simplified installation procedure estimated to save roughly 20 to 25% on labor costs over prior systems which require assembly of two or more extruded parts in the field.

Figure 19:
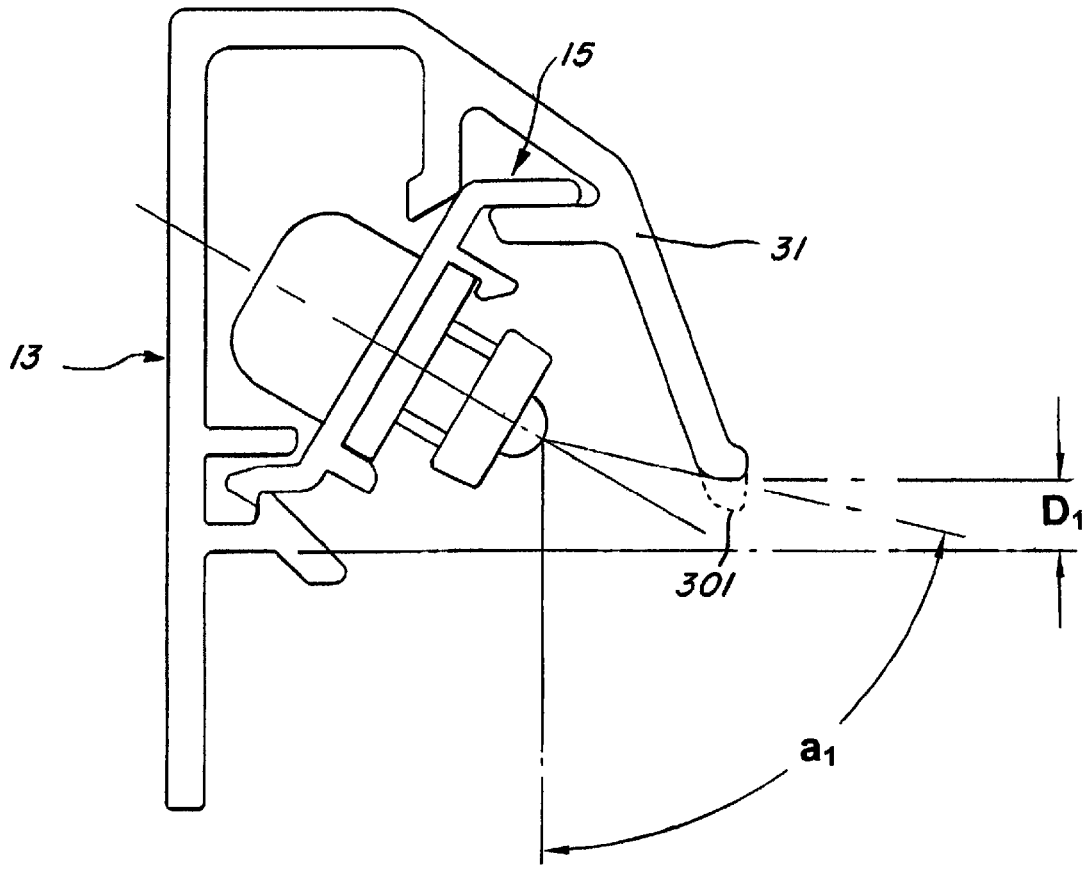
FIG. 19 is a schematic side view illustrating an embodiment enabling precise control of light cut off.

Another advantage of the illustrated construction is that positive control of the light emitted by the LED lamps, e.g. 53, may be achieved such that the bottoms of the lamps are not normally visible to patrons. The precise light control facilitated by the illustrative embodiments is further illustrated in FIG. 19. To provide effective light control, it is desirable to hold a tolerance of +/−0.005 inches on dimension "$D_1$", which establishes alight cut off point and the size of light passage or light transmission arc $a_1$. Provision of a single piece extrusion 13 and other structural features, together with a "trim off" feature, enables holding the tolerance on $D_1$ to the desired value. According to the trim-off feature, an extra amount of material 301 is formed at the end of the light shield portion 31 of the single piece extrusion 15 during the extrusion process. Precise machine trimming-off of the portion 301 then permits holding the tolerance on $D_1$ to the desired +/−0.005 inches.

Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A wall light apparatus comprising:

a single piece wall mount extrusion and a single piece lampholder, wherein:

the single piece wall mount extrusion includes a vertical rear mounting surface with an interior surface having first and second projections extending therefrom, the first and second projections defining a slot for receiving a lower tongue of the lampholder; and wherein the top of the rear mounting surface has a shield formed thereon, which includes a first horizontally extending planar section, a second planar section, integrally formed with the first horizontal planar section and angled downwardly therefrom, and a third planar section integrally formed with the second section and angled downwardly therefrom; and wherein the interior of the shield has formed thereon a downward extending vertical projection and a horizontal projection, the vertical and horizontal projections being shaped and dimensioned to define an upper slot into which fits an upper tongue of the lamp holder.

2. The apparatus of claim 1 wherein the lampholder comprises tongues which retain a circuit board, which mounts one or more LEDs.

3. The apparatus of claim 2 wherein respective side light shields are located on opposite sides of the circuit board.

4. The apparatus of claim 1 further comprising a circuit board mounted on a front surface of said lampholder and carrying one or more LEDs.

5. The apparatus of claim 4 further comprising means for spacing said circuit board apart from the front surface of said lampholder to define a gap between said front surface and said circuit board.

6. The apparatus of claim 5 wherein said means comprises first and second depressions.

7. The apparatus of claim 5 further comprising a prying tool having a portion insertable into said gap for prying said circuit board out of the lampholder.

8. The apparatus of claim 4 wherein said lampholder is shaped and dimensioned to snap upper extrusion by first inserting said upper tongue into said second slot and thereafter snapping said lower tongue into said first slot.

9. The apparatus of claim 8 wherein said extrusion is fabricated with an overextended end on said horizontally extending light shield which is then trimmed off to a tolerance necessary to avoid exposing the LEDs to normal view.

10. The apparatus of claim 8 further comprising:

first and second apertures in said circuit board disposed opposite respective first and second apertures in said lampholder; and first and second electrical conductor pins passing through the respective first and second apertures of said circuit board and lampholder.

11. The apparatus of claim 10 further comprising:

first and second electrical leads connected to said first and second conductor pins and running adjacent a back surface of said lampholder; and a pin retainer releasably mountable to said back surface to retain said pins and leads in position.

12. The apparatus of claim 4 wherein the third planar extension is fabricated with an overextended end which is then trimmed off to a tolerance necessary to avoid exposing the LEDs to normal view.

13. A wall light apparatus comprising:

a wall mountable extrusion having a vertical rear mounting surface and a horizontally extending light shield;

first and second projections extending from said vertical rear mounting surface and defining a first slot;

third and fourth projections extending from an interior surface of said light shield and defining a second slot;

a lampholder having upper and lower tongues positioned to fit in said first and second slots; and a circuit board mounted on a front surface of said lampholder and carrying one or more LEDs.

14. The apparatus of claim 13 wherein said light shield comprises a first horizontally extending planar section, a second planar section integrally formed with the first planar section and angled downwardly therefrom at a first angle, and a third planar section integrally formed with the second section and angled downwardly therefrom at a second angle.

15. The apparatus of claim 14 wherein said first and second angles are 55 and 20 degrees to the vertical respectively.

16. The apparatus of claim 13 further comprising a plurality of retaining tongues extending from said front surface and positioned to retain said circuit board on said front surface.

17. The apparatus of claim 16 further comprising means for spacing said circuit board apart from the front surface of said lampholder to define a gap between said front surface and said circuit board.

18. The apparatus of claim 17 wherein said means comprises first and second depressions.

19. The apparatus of claim 17 further comprising a prying tool having a portion insertable into said gap for prying said circuit board out of the lampholder.

20. The apparatus of claim 17 wherein said lampholder is shaped and dimensioned to snap into said extrusion.

21. The apparatus of claim 20 wherein said lampholder is shaped and dimensioned to snap into said extrusion by first inserting said upper tongue into said second slot and thereafter snapping said lower tongue into said first slot.

22. The apparatus of claim 21 further comprising a wireway cover comprising an upper surface shaped positioned to fit into said second slot and a lower surface shaped and positioned to fit into said first slot.

23. The apparatus of claim 22 wherein said upper surface is first inserted into said second slot and said lower surface is thereafter snapped into said first slot.

24. The apparatus of claim 17 wherein said extrusion is fabricated with an overextended end on said horizontally extending light shield which is then trimmed off to a tolerance necessary to avoid exposing the LEDs to normal view.

25. The apparatus of claim 16 further comprising first and second depressions in the front surface of said lampholder for receiving soldering located on a back surface of said circuit board and having a depth dimensioned to create a gap between said front surface and said back surface.

26. The apparatus of claim 13 further comprising respective side light shields positioned on opposite sides of said circuit board.

27. The apparatus of claim 26 further comprising a plurality of light shields formed between said side light shields along a lower edge of said lampholder.

28. The apparatus of claim 13 wherein said lampholder is shaped and dimensioned to snap into said extrusion.

29. The apparatus of claim 28 wherein said lampholder is shaped and dimensioned to snap into said extrusion by first inserting said upper tongue into said second slot and thereafter snapping said lower tongue into said first slot.

30. The apparatus of claim 13 further comprising a wireway cover comprising an upper surface shaped and positioned to fit into said second slot and a lower surface shaped and positioned to fit into said first slot.

31. The apparatus of claim 30 wherein said upper surface is first inserted into said second slot and said lower surface is thereafter snapped into said first slot.

32. The apparatus of claim 30 where said wireway cover further adds structural stiffness to the wall mountable extrusion.

33. The apparatus of claim 4 wherein said extrusion is fabricated with an overextended end on said horizontally extending light shield which is then trimmed off to a tolerance necessary to avoid exposing the LEDs to normal view.

34. The apparatus of claim 13 further comprising:

first and second apertures in said circuit board disposed opposite respective first and second apertures in said lampholder; and first and second electrical conductor pins passing through the respective first and second apertures of said circuit board and lampholder.

35. The apparatus of claim 34 further comprising:

first and second electrical leads connected to said first and second conductor pins and running adjacent a back surface of said lampholder; and a pin retainer releasably mountable to said back surface to retain said pins and leads in position.

36. A wall light apparatus comprising:

a wall mountable extrusion having a vertical rear mounting surface, the vertical rear mounting surface having a vertical inner wall and a horizontally extending light shield, the horizontally extending light shield terminating at an end edge;

first and second projections extending from the vertical inner wall of said vertical rear mounting surface and defining a first slot;

third and fourth projections located on an interior surface of said light shield between said end edge and said vertical wall and defining a second slot; and a lampholder having an upper tongue shaped and dimensioned to fit in said second slot and a lower tongue projecting inwardly to fit in said first slot.

37. The apparatus of claim 36 wherein said light shield comprises a first horizontally extending planar section, a second planar section integrally formed with the first planar section and angled downwardly therefrom at a first angle, and a third planar section integrally formed with the second section and angled downwardly therefrom at a second angle.

38. The apparatus of claim 37 wherein said first and second angles are 55 and 20 degrees to the vertical respectively.

39. The apparatus of claim 37 wherein the third planar extension is fabricated with an overextended end which is then trimmed off to a tolerance necessary to avoid exposing the LEDs to normal view.

40. The apparatus of claim 36 further comprising a circuit board mounted on a front surface of said lampholder and carrying one or more LEDs.

41. The apparatus of claim 36 further comprising respective side light shields positioned on opposite sides of said circuit board.

42. The apparatus of claim 41 further comprising a plurality of light shields formed between said side light shields along a lower edge of said lampholder.

43. The apparatus of claim 41 further comprising means for spacing said circuit board apart from the front surface of said lampholder to define a gap between said front surface and said circuit board.

44. The apparatus of claim 43 wherein said means comprises first and second depressions.

45. The apparatus of claim 44 further comprising a prying tool having a portion insertable into said gap for prying said circuit board out of the lampholder.

46. The apparatus of claim 36 wherein said lampholder is shaped and dimensioned to snap into said extrusion by first inserting said upper tongue into said second slot and thereafter snapping said lower tongue into said first slot.

47. The apparatus of claim 46 wherein said extrusion is fabricated with an overextended end on said horizontally extending light shield which is then trimmed off to a tolerance necessary to avoid exposing the LEDs to normal view.

48. The apparatus of claim 46 further comprising:

first and second apertures in said circuit board disposed opposite respective first and second apertures in said lampholder; and first and second electrical conductor pins passing through the respective first and second apertures of said circuit board and lampholder.

49. The apparatus of claim 48 further comprising:

first and second electrical leads connected to said first and second conductor pins and running adjacent a back surface of said lampholder; and a pin retainer releasably mountable to said back surface to retain said pins and leads in position.

* * * * *